United States Patent [19]

Hida

[11] Patent Number: 4,896,127

[45] Date of Patent: Jan. 23, 1990

[54] LAGGED TYPE SOLENOID

[75] Inventor: Etsushi Hida, Shizuoka, Japan

[73] Assignee: Kabushiki Kaisha Nippon Automation, Japan

[21] Appl. No.: 267,522

[22] Filed: Nov. 4, 1988

[30] Foreign Application Priority Data

Dec. 21, 1987 [JP] Japan ..... 62-321570
Dec. 21, 1987 [JP] Japan ..... 62-321571

[51] Int. Cl.[4] ..... H01H 7/18

[52] U.S. Cl. ..... 335/239; 335/240; 335/253

[58] Field of Search ..... 335/238, 239, 240, 241, 335/215, 254, 253

[56] References Cited

U.S. PATENT DOCUMENTS 3,983,520 9/1976 Sakata ..... 335/239 X
4,044,323 8/1977 Sleger ..... 335/240

FOREIGN PATENT DOCUMENTS 146911 11/1980 Japan ..... 335/239

*Primary Examiner*—George Harris
*Attorney, Agent, or Firm*—Steinberg & Raskin

[57] ABSTRACT

A lagged type solenoid capable of carrying out the plunger advancing operation at a speed lower than the plunger retreating operation. For this purpose, the solenoid includes a plunger lagging mechanism, which includes an air discharge passage for discharging air in a plunger moving space to an ambient atmosphere during the plunger advancing operation and an air supply passage for supplying air from the ambient atmosphere to the plunger moving space during the plunger retreating operation which is formed into a sectional area larger than the air discharge passage. The air supply passage is closed by a check valve during the plunger advancing operation. Thus, the plunger advancing operation takes place at a speed lower than the plunger retreating operation.

24 Claims, 9 Drawing Sheets

LAGGED TYPE SOLENOID

BACKGROUND OF THE INVENTION

1. Field of the Invention

This invention relates to a lagged type solenoid, and more particularly to a lagged type solenoid adapted to carry out one of its plunger advancing operation and plunger retreating operation at a low speed.

2. Description of the Prior Art

Conventionally, a solenoid has been extensively used to move a machine part or the like within a predetermined range.

The conventional solenoid used for this purpose includes a plunger slidably fitted in a coil bobbin having a magnetic coil wound on an outer periphery thereof in a manner to be movable in an axial direction thereof. The plunger is adapted to be advanced in the coil bobbin when the magnetic coil is excited.

In the conventional solenoid constructed as described above, its plunger advancing operation is carried out in such a manner that it is rapidly accelerated immediately after start of the operation, resulting in instantaneously reaching its stroke end.

The plunger retreating operation for returning the plunger to its original position is instantaneously carried out through a return spring by turning off the magnetic coil for its non-excitation.

Accordingly, when it is desired to instantaneously actuate a machine part or the like, the conventional solenoid is effectively used because the plunger is rapidly moved. However, the conventional solenoid fails to actuate the machine part slowly or at a constant speed.

For example, the conventional solenoid is used for a pachinko or pinball game installed in an amusement place or the like in such a manner to slowly actuate a so-called tulip element for operating a hole formed on a board of the pachinko. For this purpose, the solenoid employs a mechanism which is adapted to reduce driving force of a motor through a gear mechanism or the like and then transmit it to tulip actuating means. Unfortunately, such a mechanism is complicated in structure to a degree sufficient to substantially increase a size of the pachinko as well as its cost, resulting in a large area being required to install the pachinko.

Further, positional control of the conventional solenoid is carried out at only two positions or its advanced and retreated positions, so that it is impossible to stop it in the middle of its stroke, particularly, during the plunger advancing operation.

Moreover, in the conventional solenoid, when it is desired to hold the plunger at its stroke end during the plunger advancing operation, it is required to keep the magnetic coil turned on to continue excitation of the magnetic coil, resulting in attracting the plunger to the magnetic coil. This causes power consumption of the magnetic coil to be substantially increased.

Accordingly, it would be highly desirable to develop a lagged type solenoid which is capable of carrying out one of the plunger advancing operation and plunger retreating operation slowly or at a low speed.

SUMMARY OF THE INVENTION

Generally speaking, in accordance with the present invention, a lagged type solenoid is provided. The lagged type solenoid includes a frame formed into a substantially cylindrical shape and opened at one end thereof and a coil bobbin arranged on an inner peripheral surface of the frame. The coil bobbin is formed into a substantially cylindrical shape and provided therein with an axially extending through-hole. The coil bobbin has a magnetic coil wound on an outer periphery thereof. The solenoid also includes a core arranged in a bottom of the frame so as to define a plunger moving space in cooperation with the through-hole of the coil bobbin. In the so-defined in the plunger moving space is fitted a plunger so as to be reciprocated in an axial direction thereof and advanced in the plunger moving space due to excitation of the magnetic coil. Further, the solenoid includes a plunger lagging mechanism for carrying out one of the plunger advancing operation and plunger retreating operation at a low speed in the plunger moving space.

Accordingly, it is an object of the present invention to provide a lagged type solenoid which is capable of effectively carrying out one of the plunger advancing operation and plunger retreating operation at a low speed.

It is another object of the present invention to provide a lagged type solenoid which is capable of carrying out the plunger advancing operation at a low speed.

It is another object of the present invention to provide a lagged type solenoid which is capable of being simplified in structure and small-sized.

It is a further object of the present invention to provide a lagged type solenoid which is capable of saving an installation area of a machine in which the solenoid is to be used.

It is still another object of the present invention to provide a lagged type solenoid which is capable of varying a speed of the plunger advancing operation depending on its applications.

It is yet another object of the present invention to provide a lagged type solenoid which is capable of variably controlling the plunger advancing operation and/or varying it by stages.

It is even another object of the present invention to provide a lagged type solenoid which is capable of electrically controlling the plunger advancing operation.

It is still a further object of the present invention to provide a lagged type solenoid which is capable of stopping the plunger advancing operation at any position as well as carrying out it at a low speed.

It is yet a further object of the present invention to provide a lagged type solenoid which is capable of carrying out the plunger retreating operation at a low speed.

It is an even further object of the present invention to provide a lagged type solenoid which is capable of carrying out self-holding at its stroke end during the plunger advancing operation and reducing power consumption by a magnetic coil.

It is another object of the present invention to provide a lagged type solenoid which is capable of electrically controlling a speed of slow movement of a plunger while carrying out self-holding at its stroke end during the slow movement.

It is an additional object of the present invention to provide a lagged type solenoid which is capable of carrying out the plunger advancing operation at a low speed, as well as varying a speed of the operation and stopping the operation in the middle of the operation.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals and characters designate like or corresponding parts throughout; wherein.

DESCRIPTION OF THE PREFERRED EMBODIMENTS

Now, a lagged type solenoid according to the present invention will be described hereinafter with reference to the accompanying drawings.

Figure 1:
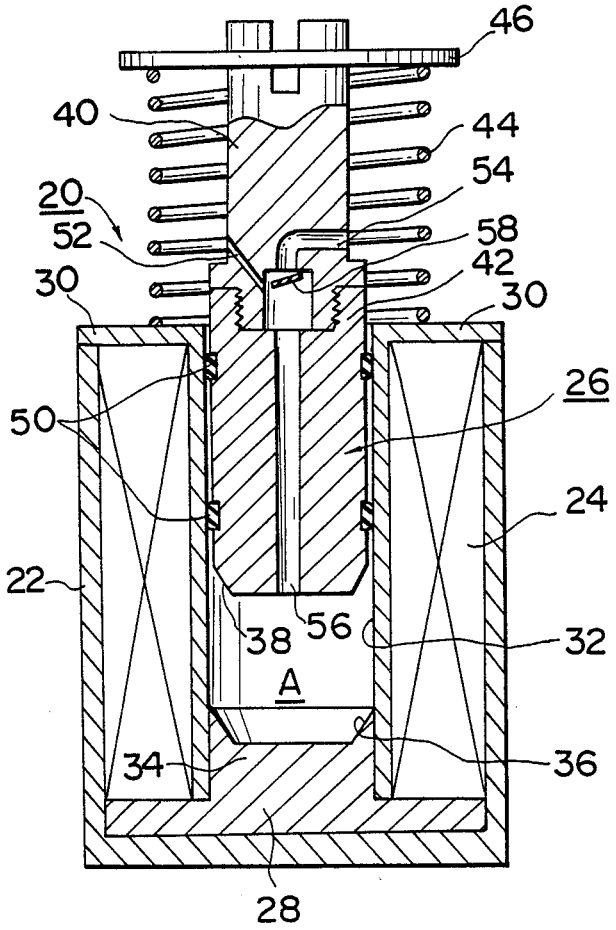
FIG. 1 is a vertical sectional view showing an embodiment of a lagged type solenoid according to the present invention.

FIG. 1 shows one embodiment of a lagged type solenoid according to the present invention. A lagged type solenoid of the illustrated embodiment generally designated at reference numeral 20 in FIG. 1 generally includes a frame 22, a magnetic coil 24 arranged in the frame 22 and a plunger 26 arranged in the frame 22.

The frame 22 is formed into a substantially cylindrical shape and opened at its one end or upper end. The frame 22 is provided therein with a fixed core 28, which is positioned on a bottom surface of the frame 22. Also, the frame 22 is provided therein with a substantially cylindrical coil bobbin 30, which is fixed on an inner peripheral surface of the frame 22. The coil bobbin 30 is formed therein with a central through-hole 32 extending in an axial direction thereof. The iron core 28 is formed on a central portion of an upper surface thereof with a circular projection 34, which is sealedly fitted in a lower portion of the through-hole 32. Thus, the through-hole 32 defines a plunger moving space A in the solenoid 20 in cooperation with the core 28, in which the plunger 26 is reciprocated. The projection 34 is formed on an upper end surface thereof with an inverted frust-conical recess 36. Any suitable cushioning and separating means (not shown) may be applied on a surface of the recess 36. The means may comprise a sheet member formed of a plastic material.

The plunger 26 is formed into a substantially cylindrical shape and is slidably inserted in the plunger moving space A. The plunger 26 is formed at a distal end or lower end thereof with an inverted frust-conical projection 38 of a shape corresponding to the frust-conical recess 36 of the core 28, so that it may be seated on the recess 36 of the core 28 when the plunger 26 reaches its stroke end during the plunger advancing operation for moving the plunger 26 in a direction toward the core 28. In the illustrated embodiment, the plunger 26 is constituted by two members or upper and lower cylindrical members 40 and 42 threadedly connected to each other.

Reference numeral 44 designates a return spring which serves to constantly force the plunger 26 in an upward direction in FIG. 1 or a plunger retreating direction. For this purpose, the return spring 44 is arranged around an upper portion of the plunger 26 and between an upper end surface of the coil bobbin 30 and a disc member 46 fixed at a proximal end of the plunger 26.

In the lagged type solenoid of the illustrated embodiment, as described above, the central through-hole 32 of the coil bobbin 30 defines, in cooperation with the core 28, the plunger moving space A in which the plunger 26 is slidably reciprocated in a vertical direction during the plunger advancing and retreating operations. The plunger moving space A should be sealedly or hermetically isolated from an exterior of the solenoid 20. In the illustrated embodiment, seal means is provided for this purpose. The seal means may comprise at least one seal ring 50 which is interposedly arranged between an inner peripheral surface of the coil bobbin 30 defining the through-hole 32 and an outer peripheral surface of the plunger 26. In the illustrated embodiment, two such seal springs 50 are arranged in a manner to be spaced from each other in an axial direction of the plunger 26. Alternatively, the seal means may be provided by strictly defining a clearance between the plunger 26 and the coil bobbin 30.

The lagged type solenoid 20 also includes a plunger lagging mechanism which is adapted to carry out at least one of the plunger advancing operation and plunger retreating mechanism slowly or at a low speed. In the illustrated embodiment, the plunger lagging mechanism includes at least one air discharge passage 52 for escaping or discharging air in the plunger moving space A therethrough to the exterior of the solenoid 20 during the plunger advancing operation and at least one air supply passage 54 for introducing or supplying air from the exterior therethrough to the plunger moving space A during the plunger retreating operation. In the illustrated embodiment, each one such supply discharge passage 52 and supply passage 54 are provided. Also, both passages 52 and 54 are formed in the plunger 26. The air discharge passage 52 is formed into a small sectional area as compared with the air supply passage 54. This means that the latter 54 is formed into a sectional area larger than that of the former 52. The sectional area of the former is preferably much smaller than that of the latter.

More particularly, in the illustrated embodiment, the plunger 26 is formed therein with an air passage 56 axially extending by a suitable distance from its distal end or lower end. The air discharge passage 52 of a small sectional area is formed in the plunger 26 in such a manner that it obliquely upwardly extends from an upper portion of the air passage 56 to the outer peripheral surface of the plunger 26, resulting in the plunger moving space A being communicated through the air passage 56 and air discharge passage 52 to an ambient atmosphere. The air supply passage 54 is formed in the plunger 26 in a manner to extend from an upper end of the air passage 56 to the outer peripheral surface of the plunger 26, so that the plunger moving space A also may be communicated through the air passage 56 and air supply passage 54 to the ambient atmosphere. In the illustrated embodiment, the passages 52 and 54 are arranged so as to be spaced from each other by an angle of about 180 degrees, and the air supply passage 54 is formed into a substantially L-shape.

The plunger lagging mechanism also includes selective shut-off means for selectively closing the air supply passage 54 or closing it only during the plunger advancing operation, In the illustrated embodiment, the selective shut-off means 58 comprises a one-way valve or check valve 58 which is arranged at a connection between the air passage 56 and the air supply passage 54 so as to permit air to be flowed only in a direction from the exterior of the plunger to the plunger moving space A during the plunger retreating operation.

In the lagged type solenoid of the illustrated embodiment constructed as described above, air in the plunger moving space A is slowly discharged therefrom through the air discharge passage 52 to the exterior little by little while the plunger is advanced toward the core 28 in the space A, because the air discharge passage 52 is formed into a small sectional area. This results in the plunger advancing operation being slowly accomplished. During the operation, the air supply passage 54 is closed with the check valve 58, resulting in flowing of air from the exterior through the air supply passage 54 to the space A being effectively prevented. Whereas, during the plunger retreating operation, a large amount of air is rapidly supplied from the ambient atmosphere through the air supply passage 54 to the plunger moving space A, because the passage 54 is formed into a large sectional area. This results in the plunger retreating operation being rapidly carried out.

Thus, it will be noted that the illustrated embodiment permits the plunger advancing operation to be slowly carried out while insuring the rapid plunger retreating operation. Also, the embodiment leads to the plunger advancing operation at a constant speed.

Accordingly, the lagged type solenoid shown in FIG. 1 can be effectively used for slowly actuating a machine part without using any separate motor or reduction mechanism, resulting in simplification of a machine in which the solenoid is to be incorporated and saving of its installation space. In particular, the solenoid is effective to slowly actuate a tulip element for operating a hole of a pachinko while exhibiting the above-noted advantages.

Figure 2:
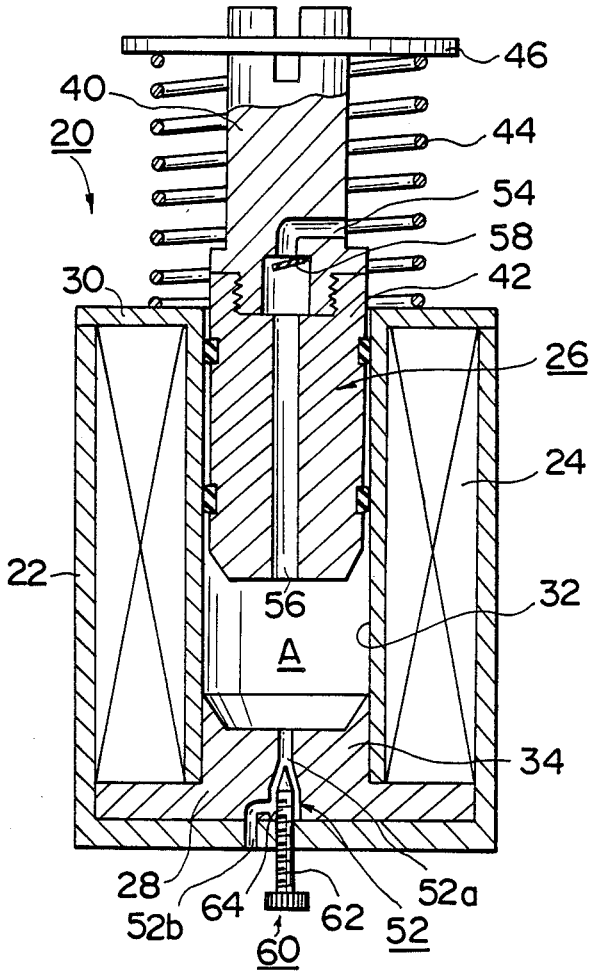
FIG. 2 is a vertical sectional view showing a modification of the embodiment shown in FIG. 1.

FIG. 2 shows a modification of the lagged type solenoid shown in FIG. 1. In a solenoid shown in FIG. 2, an air discharge passage 52 is provided so as to permit air in a plunger moving space A to be escaped through a bottom of the solenoid. Also, the air discharge passage 52 is controlled by flow control means.

More particularly, the air discharge passage 52 comprises a first passage section **52*a* formed so as to extend through a core 28 in an axial direction thereof and a second discharge passage section 52*b* formed into a substantially L-shape so as to extend from the first discharge passage section 52*a* through a bottom wall of a frame 22 to an ambient atmosphere. The flow control means comprises a needle valve 60 which includes an adjusting screw 62 threadedly fitted through the bottom wall of the frame 22 so as to extend into a lower portion of the first discharge passage section 52*a* and a valve body 64 provided at a distal end of the adjusting screw 62 so as to extend across the second discharge passage section 52*b* into the first discharge passage section 52*a*. The so-constructed and arranged needle valve 60 is operated in a such manner that the adjusting screw 62 is rotated to vertically move the valve body 64 to vary an orifice defined between an inner periphery of the first discharge passage section 52*a* and the valve body 64, to thereby control a flow rate of air discharged through the air discharge passage 52**.

Such construction of the modification described above permits a flow rate of air discharged from the plunger moving space A through the air discharge passage 52 to the ambient atmosphere to be varied to vary a rate of sliding movement of a plunger 26 in the plunger moving space A as desired. This results in the solenoid being directed to various applications. The remaining part of the modification shown in FIG. 2 may be constructed in substantially the same manner as the embodiment shown in FIG. 1.

As can be seen from the foregoing, the lagged type solenoid shown in each of FIGS. 1 and 2 is so constructed that during the plunger advancing operation, air is discharged little by little from the plunger moving space A through the air discharge passage 52 of a small sectional area to the ambient atmosphere, whereas a large amount of air is rapidly introduced from the ambient atmosphere through the air supply passage 54 of a large sectional area to the plunger moving space A. Such construction permits the plunger advancing operation to be slowly accomplished, so that the solenoid may be effectively used for a machine which is required to selectively carry out its slow movement. Also, it causes the solenoid to be simplified in structure and small-sized.

Figure 3:
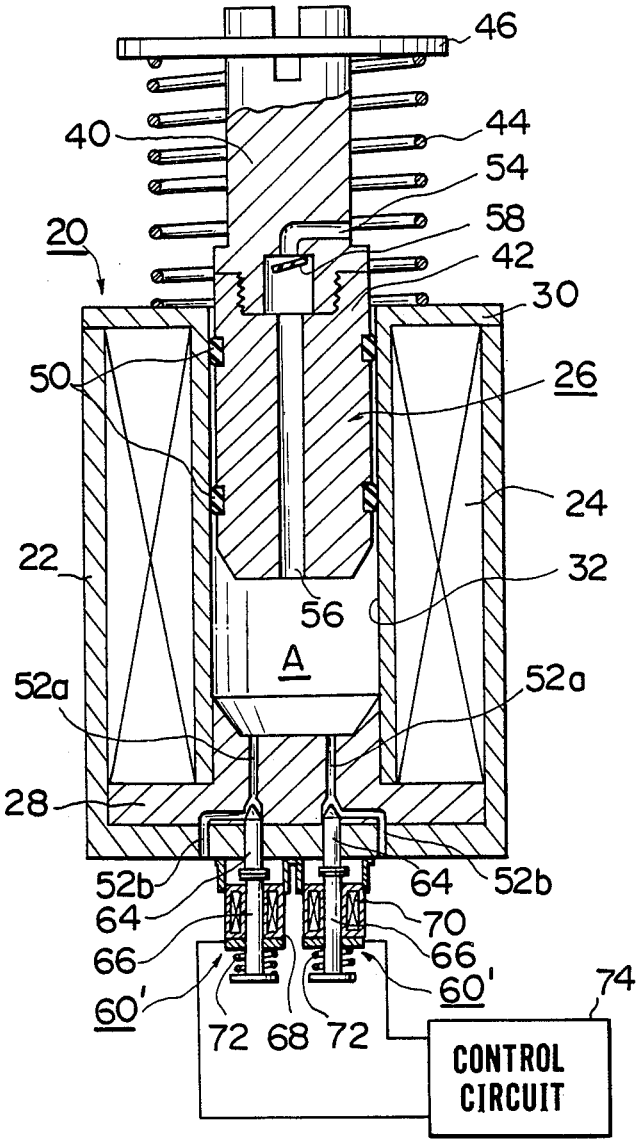
FIG. 3 is a vertical sectional view showing another modification of the embodiment shown in FIG. 1.

FIG. 3 shows another modification of the lagged type solenoid shown in FIG. 1, which is adapted to electrically control the plunger advancing operation. In a lagged type solenoid of the modification, a plunger lagging mechanism includes a pair of air discharge passages 52 symmetrically arranged and each formed in substantially the same manner as the air discharge passage 52 in the modification shown in FIG. 2. In the modification, both air supply passages 54 may be formed into the same configuration and size.

Each of the air discharge passages 52 is provided therein with flow control means which comprises a solenoid valve 60' for controlling a flow rate of air discharged therethrough from a plunger moving space A to an ambient atmosphere. The solenoid valve 60' is arranged on a bottom wall of a frame 22. The solenoid valve 60' includes a plunger 66 fitted in a coil bobbin 68 having a magnetic coil 70 wound on an outer periphery thereof so as to be slidable in an axial direction thereof and suckedly moved into the coil bobbin 68 due to excitation of the magnetic coil 70 and a valve body 64 connected to a distal end of the plunger 66 and inserted through the bottom wall of the frame 22 into a first discharge passage section **52*a* of the air discharge passage 52. Each of the plungers 66 is constantly biased in an outward or retreated direction by a return spring 72 loosely fitted thereon. Each of the so-constructed solenoid valves 60', when it is turned off, is rendered open since the plunger 66 is moved in an outward or retreated direction. This results in the air discharge passages 52 each being opened to communicate an ambient atmosphere with a plunger moving space A. When each of the solenoid valves 60' is turned on, the air discharge passage 52 is closed because the plunger 66** is moved in an inward or advanced direction.

The lagged type solenoid of the modification shown in FIG. 3 is adapted to suitably combine opening and closing of the air discharge passages 52 to variably control discharge of air from the plunger moving space A therethrough to the ambient atmosphere during the plunger advancing operation. More particularly, at least one of the air discharge passages 52 is selectively opened through selective actuation of the solenoid valves 60' to variably control a flow rate of the discharged air or vary it by stages or successively, resulting in the plunger advancing operation being variably controlled or varied by stages as desired.

Turning-on or turning-off of each of the solenoid valves 60' may be controlled by means of a control circuit 74 which may be constructed in such a suitable manner as widely known in the art.

In the lagged type solenoid of FIG. 3 constructed as described above, during the plunger advancing operation, air in the plunger moving space A is discharged little by little through at least one air discharge passage 52 selectively opened, resulting in the operation being slowly carried out, during which an air supply passage 54 is kept closed with a check valve 58.

In the plunger retreating operation, the check valve 58 opens the air supply passage 54 to cause a large amount of air to be rapidly introduced from the ambient atmosphere through the passage 54 to the plunger moving space A, so that the plunger 26 may be rapidly retreated.

Thus, it will be noted that the modification of FIG. 3 likewise permits the plunger advancing operation to be slowly carried out while ensuring the rapid plunger retreating operation, so that it may exhibit the same advantages as the embodiment of FIG. 1.

Also, in the above-described construction of the modification, a suitable combination between opening and closing of both air discharge passages 52 due to desired turning-on or turning-off of the solenoid valves 60' permits a flow rate of air discharged from the plunger moving space A to be variably set or varied by stages, resulting in a speed of the plunger advancing operation to be variably set or varied by stages depending on its applications as desired.

Further, use of the solenoid valve 60' in the modification permits remote control of the variable plunger advancing operation to be carried out by means of an electrical signal, as well as the plunger to be stopped at any desired position in the middle of the plunger advancing operation.

The air discharge passages may be formed into the same sectional area or different sectional areas.

In the modification of FIG. 3, two such air discharge passages 52 are provided so that the plunger advancing operation may be carried out at two different speeds due to any combination between opening and closing of the passages 52. However, three or more such air discharge passages may be provided so as to permit the operation to be carried out at three or more different speeds.

Also, the solenoid of FIG. 3 may be operated in a manner to vary a combination between the opening and closing of the air discharge passages 52 during the plunger advancing operation. This permits a speed of the plunger advancing operation to be varied by stages in the middle of the operation. Also, closing of all the air discharge passages 52 at any desired position in the middle of the operation causes the plunger 26 to be stopped in the middle of the operation.

The remaining part of the modification shown in FIG. 3 may be constructed in substantially the same manner as the embodiment shown in FIG. 1.

A further modification of the embodiment shown in FIG. 1 will be described hereinafter with reference to FIG. 4.

Figure 4:
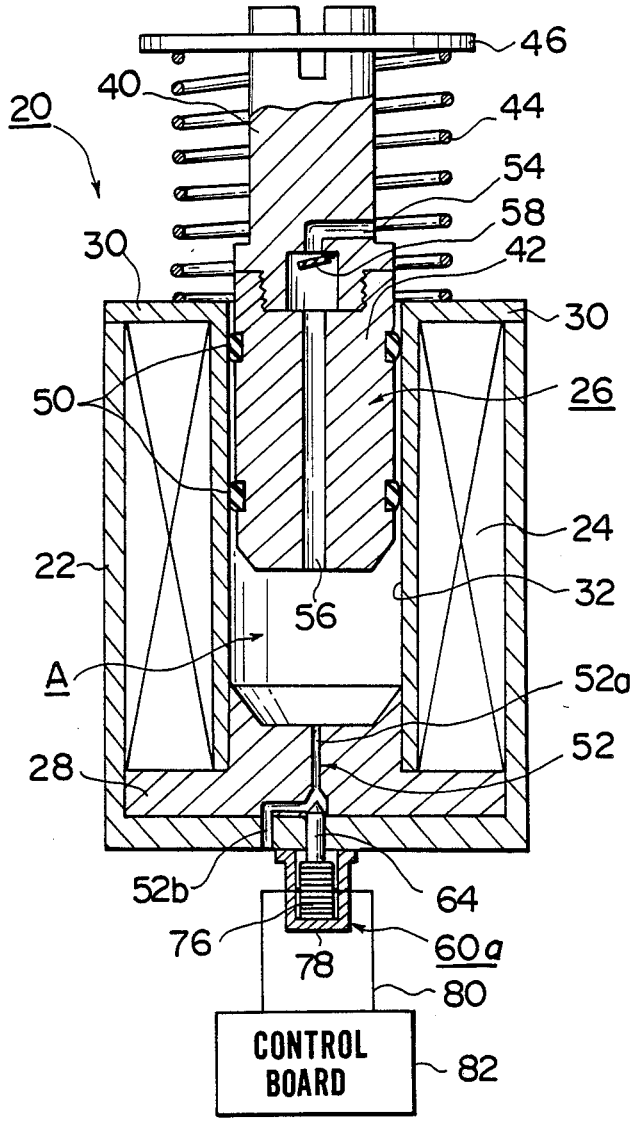
FIG. 4 is a vertical sectional view showing a further modification of the embodiment shown in FIG. 1.

A lagged type solenoid 20 shown in FIG. 4 is adapted to interrupt the plunger advancing operation or stop a plunger at any desired position in the middle of the plunger advancing operation as well as accomplish it at a low speed. In the solenoid 20, a single air discharge passage 52 is formed in substantially the same manner as the modification shown in FIG. 2 The air discharge passage 52 is controlled by the solenoid valve 60', which includes a valve body 64 movably inserted into the air discharge passage 52 and an actuator 76 for actuating the valve body 64. The actuator 76 may comprise an electrostriction element of which a shape is varied due to application of a voltage thereto. The electrostriction element 76 is made of a ceramic material into a laminated structure and adapted to be expanded in a laminated direction due to application of a voltage thereto. The degree of expansion of the element is proportionally varied depending on a voltage applied thereto.

The electrostriction element 76 is so arranged that its laminated direction is substantially perpendicular to an axis of the valve body 64 and the valve body 64 is fixed at a proximal end thereof on a distal end of the element 76. The element 76 is then held on a bracket 78 mounted on a bottom wall of a frame 22.

An initial position of the valve body 64 is so predetermined that a degree of opening of the air supply passage 52 is maximized when a voltage is not applied to the electrostriction element 76. Also, the element 76 is advanced or moved into the air discharge passage 52 due to expansion of the element 76 by application of a voltage thereto, resulting in an increase in degree of constriction of the passage 52 or a decrease in degree of its opening. Thus, forward movement of the valve body 64 is adjusted depending on a degree of application of a voltage to the element 76, so that a flow rate of air discharged through the passage 52 may be variably controlled as desired.

The electrostriction element 76 constituting the actuator is connected through an output line 80 to a voltage control board 82 which is adapted to control a voltage to be applied to the element 76.

The remaining part of the modification may be constructed in substantially the same manner as the embodiment shown in FIG. 1.

In the solenoid of FIG. 4 constructed as described above, during the plunger advancing operation, air in a plunger moving space A is discharged little by little through the air discharge passage 52 of which a degree of opening or constriction is adjusted to a desired level by the flow control means **60*a*, resulting in the operation being slowly carried out. During the operation, an air supply passage 54 is kept closed with a check valve 58**.

Also, in the modification, when a voltage applied to the electrostriction element 76 is maximized during the plunger advancing operation to close the air discharge passage 52 with the valve body 64, the plunger 26 may be stopped at that position. Such control may be carried out through the voltage control board 82.

The plunger retreating operation is rapidly carried out because a large amount of air is supplied from an ambient atmosphere through the air supply passage 54 of a large sectional area to the plunger moving space A.

Thus, it will be noted that the modification shown in FIG. 4 likewise carry out the plunger advancing operation at a low speed while ensuring the plunger retreating operation at a high speed.

In addition, the above-described construction of the modification shown in FIG. 4 permits adjustment of opening of the air discharge passage 52 to be carried out through control of application of a voltage to the electrostriction element 76 to continuously vary a flow rate of air from the plunger moving space A, resulting in the plunger advancing operation being continuously varied.

Moreover, the solenoid of the modification permits the plunger to be stopped at any desired position in the middle of the plunger advancing operation, resulting in desired positional control of a machine part to be driven by the solenoid. Also, the modification uses the electrostriction element 76 for the flow control means 60*a*, accordingly, the plunger advancing operation and stopping of the plunger during the operation may be remotely controlled by means of an electrical signal.

In the modification, as described above, the initial position of the valve body 64 is so determined that the degree of opening of the air discharge passage 52 may be maximized when a voltage is not applied to the electrostriction element 76 and the valve body 64 is advanced or forwardly moved due to expansion of the element 76 by application of a voltage thereto. However, the embodiment may be constructed in such a manner that the initial position is so determined that the air discharge passage is closed when a voltage is not applied to the electrostriction element 76 and the valve body 64 is retreated or backwardly moved due to constriction of the element 76 by application of a voltage to the element.

A piezoelectric element may be substituted for the electrostriction element 76.

As can be seen from the foregoing, the lagged type solenoid of the modification permits the plunger advancing operation to be continuously and accurately varied by remote control using an electrical signal and the plunger to be stopped at any position in the middle of the plunger advancing operation, resulting in being directed to a variety of applications.

Figure 5:
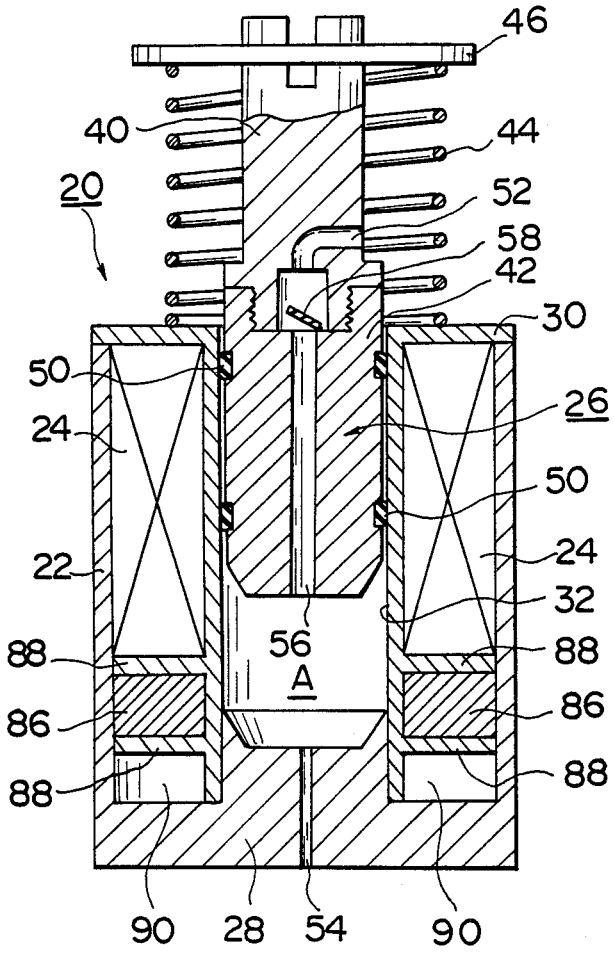
FIG. 5 is a vertical sectional view showing another embodiment of a lagged type solenoid according to the present invention.

FIG. 5 shows another embodiment of a lagged type solenoid according to the present invention. A solenoid 20 shown in FIG. 5 is adapted to carry out the plunger retreating operation slowly or at a low speed. For this purpose, a frame 22 is made of a magnetic material and at least a lower cylindrical member 42 of a plunger 26 is also made of a magnetic material.

A plunger lagging mechanism for carry out the plunger retreating operation slowly includes at least one air discharge passage 52 for escaping air in a plunger moving space A therethrough to an exterior of the solenoid 20 during the plunger advancing operation and at least one air supply passage 54 for supply air from the exterior therethrough to the plunger moving space A during the plunger retreating operation. In the illustrated embodiment, each one such supply discharge passage 52 and supply passage 54 are provided. The air discharge passage 52 is formed in the plunger 26 in a manner to extend therethrough, whereas the air supply passage 54 is formed so as to axially extend through a core 28, resulting in a plunger moving space being communicated therethrough to an ambient atmosphere. The air discharge passage 52 is formed into a large sectional area as compared with the air supply passage 54. This means that the latter 54 is formed into a sectional area smaller than that of the former 52.

More particularly, in the illustrated embodiment, the plunger 26 is formed therein with an air passage 56 axially extending by a suitable distance from its distal end. The air discharge passage 52 of a large sectional area is formed in the plunger 26 in a manner to extend from an upper end of the air passage 56 to an outer peripheral surface of the plunger 26, so that the space A also may be communicated through the air passage 56 and air discharge passage 52 to an ambient atmosphere.

The plunger lagging mechanism also includes selective shut-off means 58 for selectively closing the air discharge passage 52 during the plunger retreating operation, In the illustrated embodiment, the selective shut-off means 58 comprises a one-way valve or check valve which is arranged at a connection between the air passage 56 and the air discharge passage 52 so as to permit air to be flowed only in a direction from the plunger moving space A to the exterior of the plunger during the plunger advancing operation.

Also, the solenoid shown in FIG. 5 includes a ringlike permanent magnet 86 which generates magnetic force sufficient to keep the distal end of the plunger 26 seated on the core 28 when the plunger 26 reaches its stroke end during the plunger advancing operation. The magnet 86 may be arranged at a position corresponding to the stroke end and adjacent to one end of a magnetic coil 24. For this purpose, in the illustrated embodiment, the permanent magnet 86 is received in an annular closed space defined by a pair of annular plate members 88 vertically spacedly arranged below the magnetic coil 24. The annular plate members 88 may be formed integral with a coil bobbin 30. Also, a space gap 90 is formed between the plate members 88 and the core 28.

In the solenoid of FIG. 5 constructed as described above, the check valve 58 opens the air discharge passage 52 of a large sectional area during the plunger advancing operation, to thereby cause air in the plunger moving space A to be rapidly discharged therefrom through the passage 52 to the ambient atmosphere. This results in the plunger advancing operation being carried rapidly or at a high speed.

On the contrary, during the plunger retreating operation, air is supplied little by little from the ambient atmosphere through the air supply passage 54 of a small sectional area to the plunger moving space A, so that the operation may take place slowly or at a low speed, during which the air discharge passage 52 is closed with the check valve 58.

When the plunger 26 reaches its stroke end or is seated on the core 28 during the plunger advancing operation, the plunger 26 constitutes a part of a magnetic path of the permanent magnet 86 in cooperation with the core 28, resulting in being self-held even when the magnetic coil is turned off. Accordingly, the embodiment eliminates a necessity of continuing excitation of the magnetic coil 24 for holding the plunger 26 at the stroke end.

In this instance, flowing of a pulse current through the magnetic coil 24 causes the plunger 26 to be instantaneously advanced to the stroke end and seated on the core, and then the plunger is self-held by magnetic force of the permanent magnet 86.

Then, when a pulse current is flowed through the magnetic coil 24 in a direction opposite to that of the pulse current flowed therethrough during the plunger advancing operation after the lapse of a certain time to cause the magnetic coil to generate magnetic force overcoming self-holding force of the permanent magnet, the plunger 26 is separated from the core 28 and then returned or retreated to the original position by a return spring 44 while sucking air little by little from the ambient atmosphere through the air supply passage 54 of a small sectional area to the plunger moving space A.

Thus, it will be noted that the illustrated embodiment ensures the rapid plunger advancing operation and slow plunger retreating operation.

The embodiment of FIG. 5, as described above, causes the plunger 26 to be self-held by magnetic force of the permanent magnet 86 even if the magnetic coil 24 is turned off, when the plunger reaches its stroke end during the plunger advancing operation or is seated on the core 28, so that it is not required to continue excitation of the magnetic coil 24 for keeping the plunger seated on the core 28. This results in reducing power consumed by excitation of the magnetic coil.

The remaining part of the embodiment may be constructed in substantially the same manner as the embodiment of FIG. 1.

Figure 6:
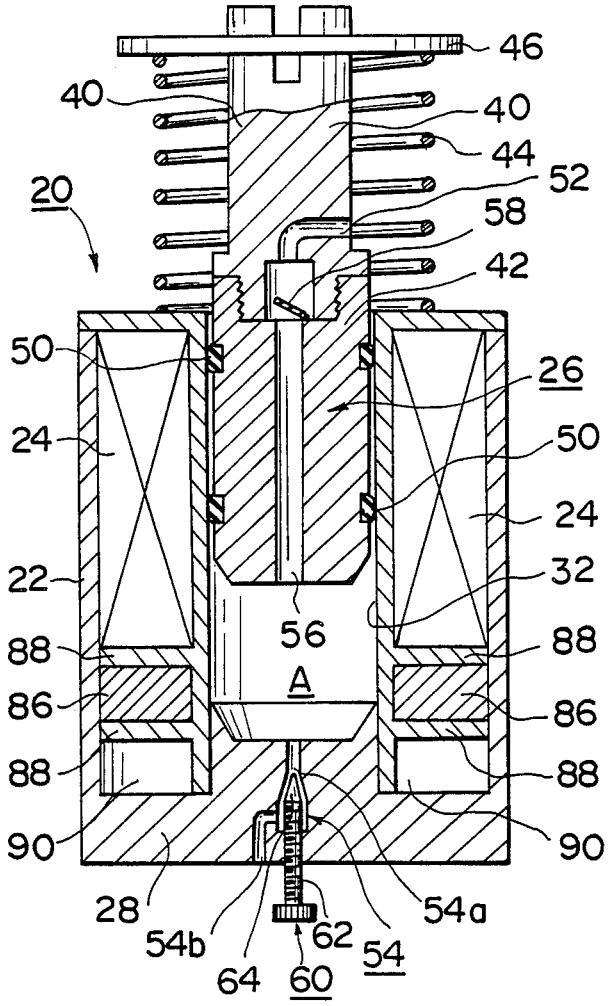
FIG. 6 is a vertical sectional view showing a modification of the embodiment shown in FIG. 5.

FIG. 6 shows a modification of the embodiment shown in FIG. 5. A lagged type solenoid of the modification is adapted to control a flow rate of air introduced through an air supply passage 54 to vary a speed of the slow plunger retreating operation. For this purpose, the air supply passage 54 comprises a first supply passage section 54*a* formed so as to extend through a core 28 in an axial direction thereof and a second supply passage section 54*b* formed into a substantially L-shape so as to extend from the first supply passage section 54*a* through a bottom wall of a frame 22 to an ambient atmosphere. Also, a flow control means is provided which comprises a needle valve 60 including an adjusting screw 62 threadedly fitted through the bottom wall of the frame 22 so as to extend into a lower portion of the first supply passage section 54*a* and a valve body 64 provided at a distal end of the adjusting screw 62 so as to extend across the second supply passage section 54*b* into the first supply passage section 54*a*. The adjusting screw 62 and valve body 64 may be integrally formed. The so-constructed constructed and arranged needle valve 60 is operated in a such manner that the adjusting screw 62 is rotated to vertically move the valve body 64 to vary an orifice defined between an inner periphery of the first supply passage section 54*a* and the valve body 64, to thereby control a flow rate of air introduced through the air supply passage 54.

The construction of the modification described above permits a flow rate of air supplied from the ambient atmosphere through the air supply passage 54 to a plunger moving space A to be varied to vary a rate of movement of a plunger 26 in the plunger moving space A as desired. This results in the solenoid being directed to various applications. The remaining part of the modification may be constructed in substantially the same manner as the embodiment of FIG. 5.

As can be seen from the foregoing, the solenoid shown in each of FIGS. 5 and 6 eliminates a necessity of continuing excitation of the magnetic coil for acting the magnetic coil on the plunger, because the plunger is self-held by magnetic force of the permanent magnet even if the magnetic coil is turned off when the plunger reaches its stroke end during the plunger advancing operation, resulting in reducing power consumption by the magnetic coil.

It is a matter of course that arrangement of the permanent magnet 86 employed in the embodiment shown in FIG. 5 may be applied to each of the lagged type solenoids shown in FIGS. 1 to 4.

Figure 7:
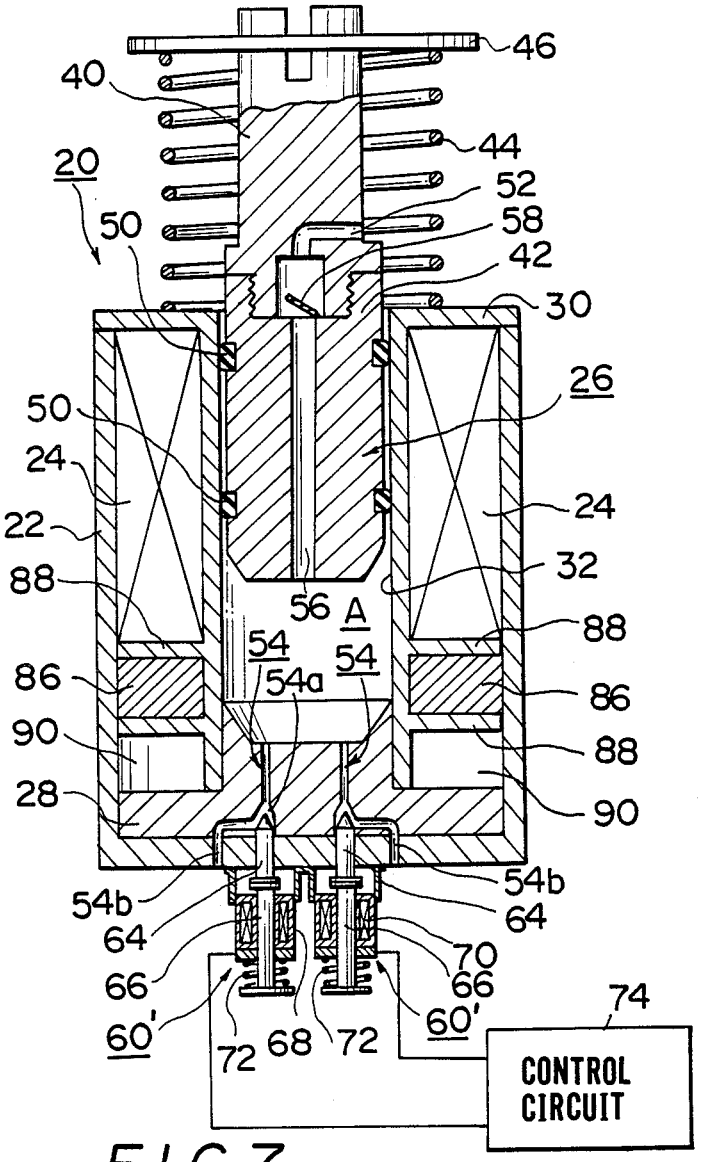
FIG. 7 is a vertical sectional view showing another modification of the embodiment shown in FIG. 5.

FIG. 7 shows another modification of the lagged type solenoid of FIG. 5, which is adapted to electrically control the plunger retreating operation. In a lagged type solenoid of the modification, a plunger lagging mechanism includes a pair of air supply passages 54 symmetrically arranged and each formed in substantially the same manner as the air supply passage 54 in the modification shown in FIG. 6. In the modification, both air supply passages 54 may be formed into the same configuration and size.

Each of the air supply passages 54 is provided therein with flow control means comprising a solenoid valve 60' for controlling a flow rate of air supplied from an ambient atmosphere therethrough to a plunger moving space A. The solenoid valve 60' is arranged on an outer surface of a bottom wall of a frame 22. The solenoid valve 60 includes a plunger 66 fitted in a coil bobbin 30 having a magnetic coil 70 wound on an outer periphery thereof so as to be slidable in an axial direction thereof and suckedly moved into the coil bobbin 68 due to excitation of the magnetic coil 70 and a valve body 64 mounted on a distal end of the plunger 66 and inserted through the bottom wall of the frame 22 into a first supply passage section 54*a* of the air supply passage 54. Each of the plungers 66 is constantly biased in an outward or retreated direction by a return spring 72 fitted thereon. Each of the so-constructed solenoid valves 60', when it is turned off, opens the air supply passage 54 since the plunger 66 is moved in an outward or retreated direction. This results in the air supply passages 54 each communicating an ambient atmosphere with a plunger moving space A. When the solenoid valve 60' is turned on, it closes the air supply passage 54 because the plunger 66 is moved in an inward or advanced direction.

The lagged type solenoid of the modification is adapted to carry out a suitable or desired combination between opening and closing of the air supply passages 54 to variably control supply of air from the ambient atmosphere to the plunger moving space A therethrough during the plunger retreating operation or vary the supply by stages. More particularly, at least one of the air supply passages 54 is selectively opened through selective actuation of the solenoid valves 60' to variably control a flow rate of the supplied air or vary it by stages or successively, resulting in the plunger retreating operation being variably controlled or varied by stages as desired.

Turning-on or turning-off of the solenoid valve 60' may be controlled by means of a control circuit 74.

The remaining part of the modification shown in FIG. 7 may be constructed in substantially the same manner as the embodiment shown in FIG. 5.

In the lagged type solenoid of FIG. 7 constructed as described above, during the plunger retreating operation, air is supplied little by little from the ambient atmosphere through the air supply passages 54 of which opening and closing are selectively combined as desired to the plunger moving space A, resulting in the plunger retreating operation being slowly carried out, during which an air discharge passage 52 is kept closed with a check valve 58.

During the plunger advancing operation, the check valve 58 opens the air discharge passage 52 of a large sectional area to cause air in the plunger moving space A to be rapidly discharged from space A through the passage 52 to the ambient atmosphere, so that the plunger 26 may be rapidly advanced.

Thus, it will be noted that the modification likewise permits the plunger advancing operation to be rapidly carried out while ensuring the slow plunger retreating operation, so that it may exhibit the same disadvantages as the embodiment shown in FIG. 5.

Also, in the above-described construction of the modification, a suitable combination between opening and closing of both air supply passages 54 due to desired turning-on or turning-off of the solenoid valves 60' permits a flow rate of air supplied from the ambient atmosphere to the plunger moving space A to be variably set or varied by stages, resulting in a speed of the plunger retreating operation carried out slowly being variably set or varied by stages depending on its applications as desired.

Further, use of the solenoid valve 60' in the modification permits remote control of the variable plunger retreating operation to be carried out by means of an electrical signal.

Thus, it will be noted that the modification can electrically variably control a speed of the slow plunger retreating operation while exhibiting advantages of the solenoid shown in FIG. 5.

In the modification of FIG. 7, two such air supply passages 54 are provided so that the plunger retreating operation may be carried out at two different speeds due to any combination between opening and closing of the passages 54. However, three or more such air supply passages may be provided so as to permit the operation to be carried out at three or more different speeds.

Also, the solenoid of FIG. 7 may be operated in a manner to vary a combination between the opening and closing of the passages 54 during the plunger retreating operation. This permits a speed of the plunger retreating operation to be varied by stages in the middle of the operation. Also, closing of all the air supply passages 54 at any desired position in the middle of the operation causes the plunger 26 to be stopped in the middle of the operation.

In the modification, the air supply passages 54 may be formed into sectional areas different from each other. This causes a speed of the plunger retreating operation to be further varied.

Figure 8:
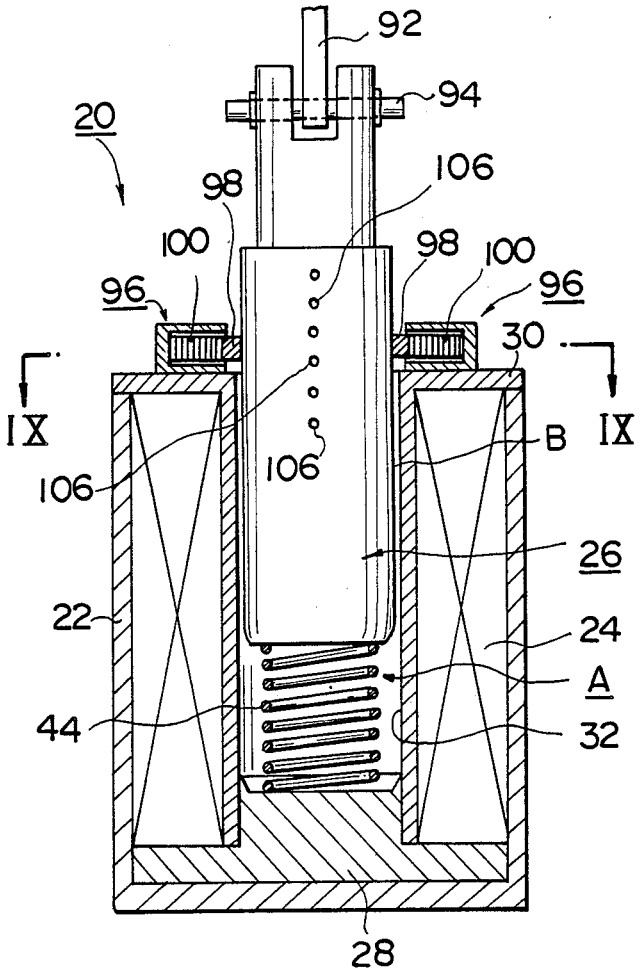
FIG. 8 is a vertical sectional view showing a further embodiment of a lagged type solenoid according to the present invention.
Figure 9:
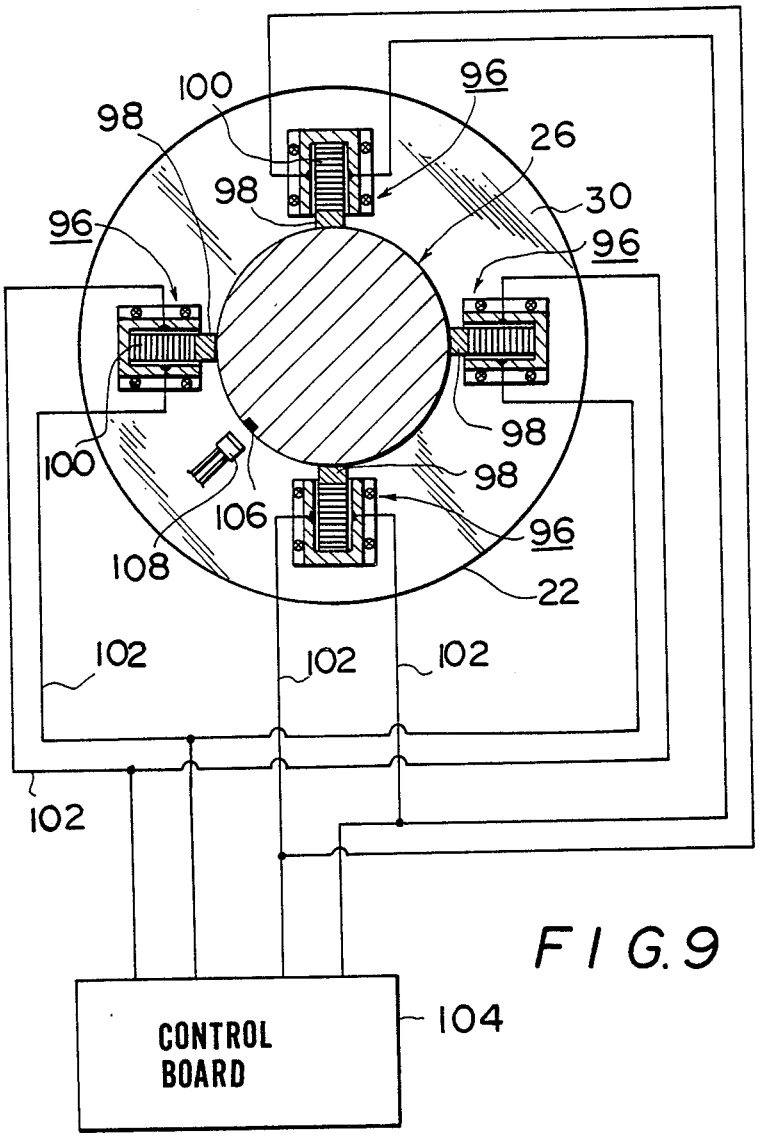
FIG. 9 is a cross sectional view taken along line IX—IX of FIG. 8.

FIGS. 8 and 9 shows a further embodiment of a lagged type solenoid according to the present invention, which is adapted to carry out the plunger advancing operation at a low speed, as well as vary a speed of the operation and stop the operation in the middle of the operation.

In a lagged type solenoid shown in FIGS. 8 and 9, a gap B of a predetermined interval is formed between an outer peripheral surface of a plunger 26 and an inner peripheral surface of a coil bobbin 30 defining a through-hole 32 of the coil bobbin 30. The so-formed gap B commonly serves as both an air discharge passage for discharging air in a plunger moving space A from the space A therethrough to an ambient atmosphere during the plunger advancing operation and an air supply passage for supplying air from the ambient atmosphere therethrough to the plunger moving space A during the plunger retreating operation.

To a proximal end of the plunger 26 is pivotally connected a rod 92 of a driven unit through a support shaft 94. The plunger 26 is constantly forced in its retreated direction or an upward direction in FIG. 8 by a return spring 44 interposed between the plunger 26 and a core 28 in the plunger moving space A.

The solenoid of the illustrated embodiment also includes a plunger braking mechanism. The braking mechanism 96 is arranged on a frame 22 and includes at least one brake element 96 comprising a brake shoe 98 arranged in a manner to be contactable with the peripheral surface of the plunger 26 and acting as a brake member and an electrostriction element 100 connected to the brake shoe 98 and deformed due to application of a voltage thereto to contact the brake shoe 98 with the plunger 26.

It is preferable that two or more such brake elements 96 are symmetrically arranged about the plunger 26. In the illustrated embodiment, four such brake elements 96 are arranged so as to be spaced from one another at an angular interval of about 90 degrees.

The electrostriction elements 100 each may be made of a ceramic material into a laminated structure and adapted to be expanded in a laminated direction due to application of a voltage thereto. The degree of expansion of the element 100 is proportionally varied depending on a voltage applied thereto. A piezoelectric element may be substituted for the electrostriction element 100.

The electrostriction element 100 is so arranged that its laminated direction is substantially parallel to a tangential direction of the plunger 26 and the brake shoe 98 is fixed on a distal end of the element 100.

The electrostriction elements 100 of the brake elements 96 of the plunger braking mechanism each are connected through lead wires 102 to a voltage control board 104, so that a voltage may be applied to each of the elements 100.

In the illustrated embodiment constructed as described above, when a voltage is applied to the electrostriction element 100 of each of the brake elements 96 to lead to a variation in shape of the element 100, each of the brake shoes 98 is pressedly contacted with the peripheral surface of the plunger 26 to apply braking force to the plunger. The braking force is varied depending on the amount of displacement of the electrostriction element 100 varied proportional to a voltage applied.

Accordingly, when braking force of a desired level is selected by suitably varying a voltage applied to the elements 100, the plunger advancing operation is carried out at a low speed. Also, the above-described construction of the embodiment permits the plunger advancing operation to be variably controlled, resulting in the solenoid being directed to wide applications. Also, the embodiment permits the plunger to be stopped in the middle of the plunger advancing operation, so that a unit driven by the solenoid may be stopped in the middle of its actuation as desired.

A position of the plunger stopped in the middle of the plunger advancing operation may be detected by a detection mechanism which includes a plurality of reflecting mirrors 106 embedded on the outer periphery of the plunger 26 in a manner to be spaced from one another by a suitable distance in an axial direction thereof and a reflection-type photosensor 108 fixed on an upper end of the coil bobbin 30 so as to be opposite to each of the mirrors 106 transferred with movement of the plunger 26 as shown in FIGS. 8 and 9. Such construction causes the photosensor 108 to detect the number of the reflecting mirrors 106 transferred across the photosensor 108 with movement of the plunger 26, so that the stopped position of the plunger 26 may be detected.

The embodiment shown in FIG. 8 and 9 is constructed so as to carry out the plunger advancing operation at a low speed. However, it may be constructed to carry out the plunger retreating operation at a low speed by actuating the plunger braking mechanism during the operation in substantially the same manner as the above.

As can be seen from the foregoing, the embodiment of FIGS. 8 and 9 is so constructed that a voltage is applied to the electrostriction elements during the plunger advancing operation to lead to displacement of the elements due to their expansion, so that the brake members or shoes may be pressedly contacted with the plunger to apply braking force to the plunger. Such construction permits the plunger advancing operation to be carried out slowly or at a low speed and a speed of the operation to be continuously varied by remote control using an electrical signal. Also, the construction permits the plunger to be stopped at a desired position in the middle of the plunger advancing operation.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A lagged type solenoid comprising:

a frame formed into a substantially cylindrical shape and opened at one end thereof;

a coil bobbin formed into a substantially cylindrical shape and provided therein with an axially extending through-hole, said coil bobbin having a magnetic coil wound on its outer periphery and being arranged on an inner peripheral surface of said frame;

a core arranged in a bottom of said frame to define a plunger moving space in cooperation with said through-hole of said coil bobbin;

a plunger fitted in said plunger moving space so as to be reciprocated in an axial direction thereof and advanced in said plunger moving space due to excitation of said magnetic coil; and a plunger lagging mechanism for carrying out one of the plunger advancing operation and plunger retreating operation at a low speed in said plunger moving space, said plunger lagging mechanism comprising:

at least one air discharge passage for discharging air in said plunger moving space from said space therethrough to an ambient atmosphere;

at least one air supply passage for supplying air from the ambient atmosphere therethrough to said plunger moving space;

one of said air discharge passage and air supply passage being formed into a sectional area larger than that of the other of said air discharge passage and air supply passage;

the sectional area of said one of said air discharge passage and air supply passage being small sufficiently to flow air between said plunger moving space and the ambient atmosphere little by little; and selective shut-off means for closing the other of said air discharge passage and air supply passage during one of said plunger advancing operation and plunger retreating operation.

2. A lagged type solenoid valve as defined in claim 1, wherein said air discharge passage is formed into a sectional area smaller than that of said air supply passage.

3. A lagged type solenoid as defined in claim 2, wherein said air discharge passage and air supply passage each are formed in said plunger and said shut-off means comprises a check valve arranged in said air supply passage.

4. A lagged type solenoid as defined in claim 2, wherein said air discharge passage is provided with flow control means.

5. A lagged type solenoid as defined in claim 4, wherein said flow control means comprises a needle valve.

6. A lagged type solenoid as defined in claim 4, wherein said flow control means comprises a solenoid valve.

7. A lagged type solenoid as defined in claim 5, wherein said air discharge passage is provided so as to extend through said core and frame and said air supply passage is provided so as to extend through said plunger.

8. A lagged type solenoid as defined in claim 1, wherein two said air discharge passages are provided;

said selective shut-off means is provided at said air supply passage and comprises a check valve.

9. A lagged type solenoid as defined in claim 8, wherein said air discharge passages are formed into sectional areas different from each other.

10. A lagged type solenoid as defined in claim 8, wherein said air discharge passages each are provided with flow control means.

11. A lagged type solenoid as defined in claim 10, wherein said flow control means comprises a solenoid valve.

12. A lagged type solenoid as defined in claim 11, wherein said solenoid valves are controlled so as to vary a flow rate of discharged air depending on a desired combination between opening and closing of both air discharge passages.

13. A lagged type solenoid as defined in claim 12, wherein said solenoid valves each comprise a valve body and an actuator for actuating said valve body;

said actuator comprising an electrostriction element.

14. A lagged type solenoid as defined in claim 1 further comprising a permanent magnet for holding said plunger at its stroke end during the plunger advancing operation.

15. A lagged type solenoid as defined in claim 14, wherein said the other of said air discharge passage and air supply passage is controlled by flow control means.

16. A lagged type solenoid as defined in claim 15, wherein said flow control means comprises a needle valve.

17. A lagged type solenoid as defined in claim 14, wherein two said air supply passages are provided; and said selective shut-off means is provided at said air discharge passage and comprises a check valve.

18. A lagged type solenoid as defined in claim 17, wherein said air supply passages are formed into sectional areas different from each other.

19. A lagged type solenoid as defined in claim 17, wherein said air supply passages each are provided with flow control means.

20. A lagged type solenoid as defined in claim 19, wherein said flow control means comprises a solenoid valve.

21. A lagged type solenoid as defined in claim 20, wherein said solenoid valves are controlled so as to vary a flow rate of supplied air depending on a desired combination between opening and closing of said two air supply passages.

22. A lagged type solenoid comprising:

a frame formed into a substantially cylindrical shape and opened at one end thereof;

a coil bobbin formed into a substantially cylindrical shape and provided therein with an axially extending through-hole, said coil bobbin having a magnetic coil wound on its outer periphery and being arranged on an inner peripheral surface of said frame;

a core arranged in a bottom of said frame to define a plunger moving space in cooperation with said through-hole of said coil bobbin;

a plunger fitted in said plunger moving space so as to be reciprocated in an axial direction thereof and advanced in said plunger moving space due to excitation of said magnetic coil; and a plunger lagging mechanism for carrying out one of the plunger advancing operation and plunger retracting operation at a low speed in said plunger moving space, said plunger lagging mechanism comprising:

an air discharge passage for discharging air in said plunger moving space from said space therethrough to an ambient atmosphere;

an air supply passage for supplying air from the ambient atmosphere therethrough to said plunger moving space; and a plunger braking mechanism for braking said plunger during one of said plunger advancing operation and plunger retreating operation to render movement of said plunger slow.

23. A lagged type solenoid as defined in claim 22, wherein said air discharge passage and air supply passage are commonly constituted by a gap between said plunger and said coil bobbin; and said plunger braking mechanism comprises at least one brake element which is arranged on said frame in proximity to said plunger and includes a brake shoe arranged in a manner to be contactable with a peripheral surface of said plunger and an electrostriction element connected to said brake shoe and deformed due to application of a voltage thereto.

24. A lagged type solenoid as defined in claim 23, wherein four said brake elements are symmetrically arranged about said plunger in a manner to be spaced from one another at an angular interval of about 90 degrees.

* * * * *